United States Patent [19]

Michael et al.

[11] Patent Number: 4,936,329

[45] Date of Patent: Jun. 26, 1990

[54] DEVICE FOR CLEANING, TESTING AND SORTING OF WORKPIECES

[75] Inventors: Klaus Michael, Gelnhausen-Haitz; Andreas Petz, Bruchköbel, both of Fed. Rep. of Germany

[73] Assignee: Leybold Aktiengesellschaft, Hanau I, Fed. Rep. of Germany

[21] Appl. No.: 345,947

[22] Filed: May 1, 1989

[30] Foreign Application Priority Data

Feb. 8, 1989 [DE] Fed. Rep. of Germany ..... 3903607

[51] Int. Cl.[5] ..... B08B 3/02; B08B 13/00

[52] U.S. Cl. ..... 134/57 R; 134/63; 134/66; 134/113; 134/153; 414/225; 901/8

[58] Field of Search ..... 901/8; 414/225, 226; 134/57 R, 58 R, 113, 63, 66, 145, 153

[56] References Cited

U.S. PATENT DOCUMENTS

| | | | |
|---|---|---|---|
| 3,823,836 | 7/1974 | Cheney et al. | 414/225 |
| 4,064,885 | 12/1977 | Dussault et al. | 134/58 R |
| 4,227,886 | 10/1980 | Bullock et al. | 134/113 X |
| 4,501,527 | 2/1985 | Jacoby et al. | 414/225 |
| 4,534,695 | 8/1985 | Stump et al. | 414/225 X |
| 4,611,749 | 9/1986 | Kawano | 901/8 X |
| 4,715,392 | 12/1987 | Abe et al. | 134/113 X |
| 4,735,220 | 4/1988 | Chandler | 134/145 |

FOREIGN PATENT DOCUMENTS

| | | |
|---|---|---|
| 0076231A2 | 4/1983 | European Pat. Off. . |
| 3540476A1 | 11/1985 | Fed. Rep. of Germany . |

OTHER PUBLICATIONS

"Universal Gripper for Hardfile Discs", IBM Technical Disclosure Bulletin, vol. 31, No. 4, Sep. 1988, pp. 210–213.

*Primary Examiner*—Philip R. Coe

*Attorney, Agent, or Firm*—Felfe & Lynch

[57] ABSTRACT

A device for the automatic cleaning, testing, and sorting of discoidal, flat substrates (9, 9', . . .) for example magnetic memory plates, having three support mandrels (12, 13, 23) for the substrates (9, 9', . . .) to be treated, three magazines (6, 7, 8) to deposit the treated and the untreated substrates (9, 9', . . .), and having a transporting device fixed to a machine frame (2) or a machine support with several transferring arms (14, 15, 16) which can be moved on several levels and which are equipped with gripping devices (20, 21, 22) is provided with a motor-driven first support mandrel (23) rotating round its longitudinal axis (r) and with a nozzle (25, 26) disposed directly adjacent to said support mandrel in order to apply a cleaning liquid onto the substrate (9, 9', . . .) which is firmly held by the first support mandrel. Moreover, each of the two further support mandrels (12, 13) disposed next to the first support mandrel (23) are provided with a scanning and testing device (27); the first transferring arm (14, 14', . . .) serves to transport the substrate (9, 9', . . .) from the first magazine (6) to the first support mandrel (23) and the second transferring arm (15, 15', . . .) serves to transport the substrate (9, 9', . . .) from the first to the second support mandrel (12) and the third transferring arm transports the substrate (9, 9', . . .) from the second to the third support mandrel and from the latter to a second or third magazine (7 or 8). An electrical circuit which is disposed in the machine frame interacts with the testing device (27), thus actuating the motors of the transferring arms (14, 15, 16).

6 Claims, 1 Drawing Sheet

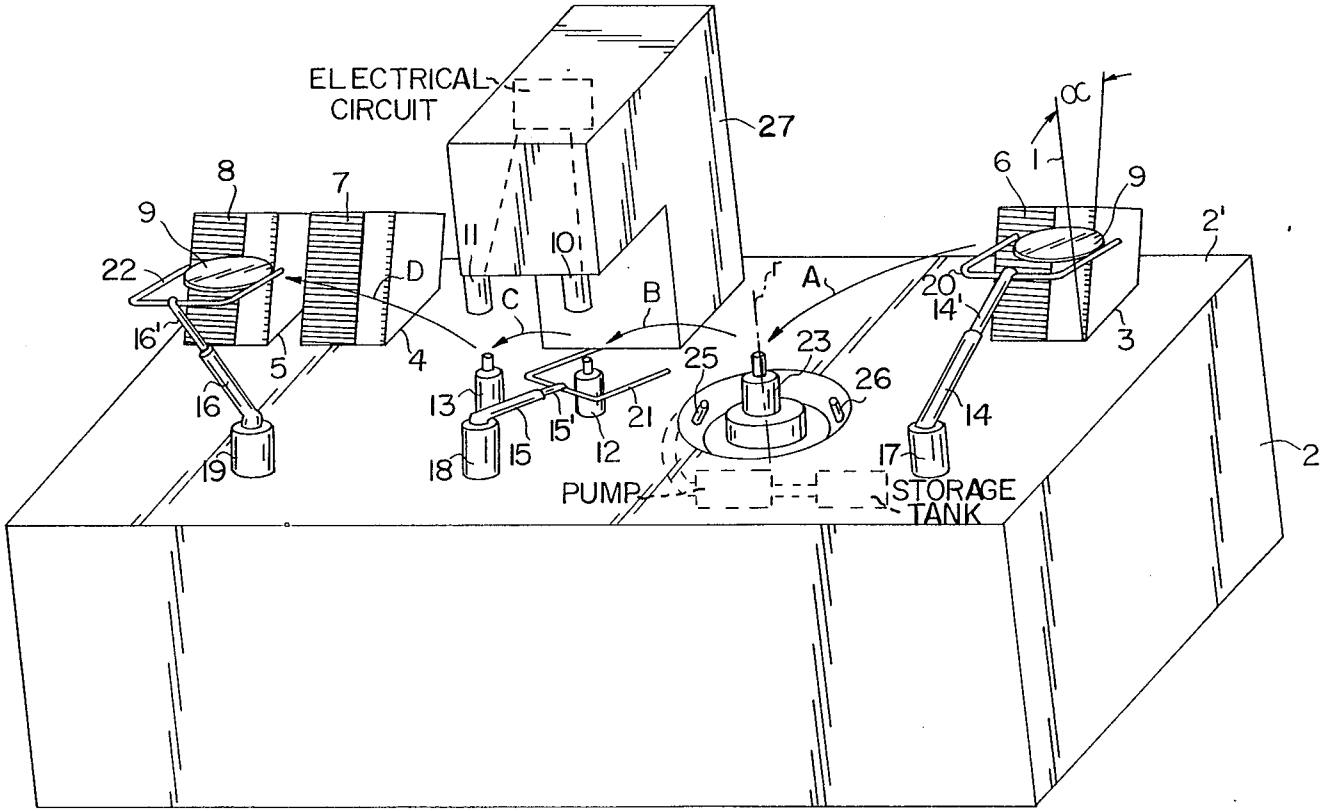
ELECTRICAL CIRCUIT
STORAGE TANK
PUMP
A
B
C
D
α

DEVICE FOR CLEANING, TESTING AND SORTING OF WORKPIECES

The invention relates to a device for cleaning, testing and sorting workpieces, preferably discoidal, flat substrates, for example magnetic memory plates, having at least one substrate holder, preferably with a support mandrel, for the substrate to be treated; having magazines to store the treated and untreated substrates and having a transporting device mounted to the machine frame or to the machine suppor with several transferring arms with gripping devices which can be moved on several levels; the axes of the stacks of the magazines are disposed angularly to the vertical and within the radius of action of the transferring arms.

It is known to work discoidal record carriers, made of metal, e.g. magnetic memory plates, on a lathe or true their lateral sides in order to obtain a maximum surface quality and accuracy of shape. Appropriate devices for trueing substrates and sorting them into correspondingly configured magazines have already been suggested (DE patent application Ser. No. P 38 37 688.1) in order to permit a rapid and precise manufacture.

A disadvantage of the known manufacturing processes is that the substrates trued and sorted into magazines are subject to contamination or damage by scratches or drag marks which can occur during transport.

It is the object of the present invention to independently perform a cleaning and integrated surface inspection, especially of magnetic memory plates, according to the "cassette to cassette" principle while the greatest possible reliability and rapidity is ensured.

This object is achieved in accordance with the invention by a first motor-driven support mandrel which rotates around its longitudinal axis and by a nozzle which is provided directly adjacent to the support mandrel to apply the cleaning liquid onto the substrate which is held by the support mandrel and two further support mandrels disposed next to the first support mandrel, furthermore, by two optical scanning and testing devices assigned to the second and third support mandrel, respectively, and by a first transferring arm to transport the substrate from the first magazine to the first support mandrel and a second transferring arm to transport the substrate from the first to the second support mandrel and a third transferring arm to transport the substrate from the second to the third support mandrel and from the latter to a second or third magazine.

Preferably, the motor-driven first support mandrel and/or the support mandrels assigned to the testing device are configured as expanding mandrels or expanding chuck and grip into a central aperture provided in the substrate and hold the latter firmly on the respective mandrel after expanding.

It is advantageous that the motor-driven first support mandrel be surrounded by a shell-shaped depression, for example an annular groove, which serves to collect the cleaning or rinsing liquid.

Jet nozzles are assigned to the first, motor-driven support mandrel which permit to apply cleaning or rinsing liquid onto the substrate held by the support mandrel.

In a preferred embodiment, there are one or several jet nozzles, which serve to apply the cleaning and rinsing liquid onto the substrate, mounted to the gripping device of the first transfer arm which is disposed on a ball-and-socket-joint.

Advantageously, the jet nozzles, provided on the first support mandrel and/or the gripping device, are connected to a pump to supply the cleaning and rinsing liquid via a pressure medium pipe from a storage tank to the jet nozzles.

In accordance with the invention, the scanning and testing device, e.g. a laser-scanner, which is disposed on the machine frame interacts with an electrical circuit which actuates the motor-driven transferring arms and the gripping devices of the latter as a function of the signals received from the sensors; those substrates identified as defective are sorted into the second magazine and substrates identified as faultless are sorted into the third magazine.

The invention permits a multitude of different embodiments one of which is represented more closely as a diagrammatic sketch in the attached drawing.

The device, strongly simplified in the drawing, basically includes a machine frame 2, the top 2' of which provides three recesses 3, 4, 5 in which the magazines 6, 7, 8 are inserted; said magazines have compartments or are provided with ridges or grooves between which the discoidal substrates 9, 9', 9'', . . . can be inserted. The individual recesses 3, 4, 5 are configured so as to hold each cuboid magazines 6, 7, 8 at an angle of e.g. 45° to the vertical 1. An optical scanning and testing device 27, e.g a laser scanner, is disposed between the two magazines 6, 7, i.e. between the first and the second magazine; said device is provided with two scanners 10, 11 which are placed above and aligned to two support mandrels 12, 13 which are mounted to the top 2' of machine frame 2. A total of three transferring arms 14, 15, 16 is mounted on the respective ball-and-socket-joints 17, 18, 19 on the front part of top 2' of the machine frame. The transferring arms, together with the ball-and-socket-joints 17, 18, 19 and the gripping devices 20, 21, 22 mounted to said transferring arms, form the transporting device which successively transfers the substrates 9, 9, . . . from the first magazine 6 to a motor-driven support mandrel 23 disposed between said magazine and a second support mandrel 18 and then from said support mandrel 23 to support mandrels 12, 13 and finally on to magazines 7, 8. The motor-driven support mandrel 23 is surrounded by a cylindrical recess which serves to collect the cleaning liquid emerging under high pressure from the nozzles 25, 26 disposed directly adjacent to the support mandrel 23; nozzles 25, 26 are aligned such that the emerging liquid crystal hits the substrate 9, 9', . . . deposited on the support mandrel 23 and the cleaning liquid dropping off the substrate is collected in recess 24.

The cleaning, testing, and sorting process is performed as follows:

The transferring arm 14, held in ball-and-socket-joint 17, moves the gripping device fixed thereto to the uppermost substrate 9, 9', . . . deposited in magazine 6, removes it from magazine 6 and transports it in a rotating motion of transferring arm 14 in direction of arrow A to the support mandrel 23 configured as an expanding mandrel which picks up substrate 9 through a central aperture provided in the substrate and holds the latter firmly. Now, nozzles 25, 26 spray the cleaning liquid under pressure onto substrate 9 which is subsequently set into a rapid rotation around rotating axis r so as to spin off the liquid of the wet substrate. Since the telescope part 14' of the transferring arm 14 permits a rotation, the substrate can be turned around after rinsing its first side and thus expose the second side of substrate 9 to a rinsing. In a second phase of working substrate 9, the latter is transported in a rotation motion by the second transferring arm 15, 15', i.e. by the gripping device 21 thereof, from support mandrel 23 to support mandrel 12 where it is deposited. The optical scanner 10 scans the first side for unevenness and contamination; subsequently, scanner 11 repeats the procedure for the second side of substrate 9 after the latter had been transported by transferring arm 16, 16' using its gripping device 22 from support mandrel 12 to support mandrel 13 and simultaneously turning it around. In a third phase transferring arm 16, 16' transports substrate 9 either to magazine 7 or to magazine 8 where it is deposited depending on the condition and the cleanliness of the surfaces. In machine frame 2, an electrical circuit (not represented) is provided for this purpose which interacts with laser-scanner 27 and actuates the electrical motors for the movement of the transferring arms 14, 14', 15, 15', 16, 16' and the gripping devices 20, 21, 22 thereof. The circuit can be programmed such that the defective substrates 9, 9', . . . are deposited in the second magazine 7 and the faultless substrates are deposited in the third magazine 8.

I claim:

1. Device for treating by cleaning, testing and sorting substrates comprising: at least one substrate holder for a substrate to be treated; a machine support with several transferring arms each having a radius of action which can be moved on different levels and which have gripping devices for gripping substrates, stacks of magazines being disposed angularly to the vertical and within the radius of action of the transferring arms; a motor-driven first support mandrel which rotates around a longitudinal axis (r), a nozzle directly adjacent to said first support mandrel in order to apply cleaning liquid onto a substrate held firmly by the first support mandrel; second and third support mandrels disposed next to the first support mandrel; an optical scanning and testing device associated with each of said second and third support mandrels; a first of said transferring arms transporting the substrate from a first magazine to the first support mandrel; a second of said transferring arms transporting the substrate from the first to the second support mandrel; a third of said transferring arms transporting the substrate from the second to the third support mandrel and from the latter to one of second and third magazines.

2. Device in accordance with claim 1, in which each substrate has a central aperture and in which the motor-driven first support mandrel and the second and third support mandrels associated with the testing device are configured as expanding mandrels and grip into a central aperture of a substrate and hold the substrate after expanding on the respective mandrel such that it cannot be moved.

3. Device in accordance with claim 1, which includes a cylindrical groove and in which the motor-driven first support mandrel is surrounded by the cylindrical groove which serves to collect the cleaning liquid.

4. Device in accordance with claim 1, in which the nozzle is a jet nozzle and which includes jet nozzles assigned to the first motor-driven support mandrel which serve to apply the cleaning liquid onto the substrate which is held by the first support mandrel.

5. Device in accordance with claim 1, which includes a pump and a pressure medium pipe in which at least one nozzle directly adjacent the first support mandrel is connected to the pump via the pressure medium pipe in order to supply the cleaning liquid from a storage tank to the at least one nozzle.

6. Device in accordance with claim 1, in which the scanning and testing device is a laser-scanner, which is disposed on he machine support and which device includes an electrical circuit, responsive to the laser-scanner, which actuates the transferring arms and the gripping devices as a function of the signals received by the scanner which permits substrates identified as defective to be deposited in a second magazine and substrates identified as faultless to be deposited in a third magazine.

* * * * *

UNITED STATES PATENT AND TRADEMARK OFFICE

CERTIFICATE OF CORRECTION

PATENT NO. : 4,936,329

DATED : June 26, 1990

INVENTOR(S) : Klaus Michael et al.

It is certified that error appears in the above-identified patent and that said Letters Patent is hereby corrected as shown below:

Column 4, line 34 for "on he machine" read

-- on the machine --.

Signed and Sealed this

Fifth Day of May, 1992

*Attest:*

DOUGLAS B. COMER

*Attesting Officer*

*Acting Commissioner of Patents and Trademarks*